United States Patent [19]

Martin

[11] Patent Number: 4,509,411

[45] Date of Patent: Apr. 9, 1985

[54] FLUID HANDLING DEVICE

[75] Inventor: Edward T. Martin, Georgetown, Canada

[73] Assignee: Axis Products Limited, Georgetown, Canada

[21] Appl. No.: 451,852

[22] Filed: Dec. 21, 1982

[51] Int. Cl.[3] ..... F24F 7/08

[52] U.S. Cl. ..... 98/34.5; 137/625.41; 137/875

[58] Field of Search ..... 98/33 R, 33 A; 137/616.7, 625.41, 875; 251/298

[56] References Cited

U.S. PATENT DOCUMENTS

| | | | |
|---|---|---|---|
| 1,584,002 | 5/1926 | Aeby et al. . | |
| 2,422,352 | 6/1947 | Harper | 137/875 X |
| 2,594,688 | 4/1952 | Shapiro | 98/94 |
| 3,302,548 | 2/1967 | Kohlmeyer | 98/33 A |
| 3,433,295 | 3/1969 | Avery | 98/33 A |
| 4,019,535 | 4/1977 | Buckethal | 137/625.41 X |
| 4,079,665 | 3/1978 | Martin | 98/33 A X |
| 4,336,748 | 6/1982 | Martin et al. | 98/33 A |

FOREIGN PATENT DOCUMENTS

| | | | |
|---|---|---|---|
| 1218703 | 5/1960 | France | 137/625.41 |
| 1218530 | 1/1971 | United Kingdom | 98/33 A |

*Primary Examiner*—Harold Joyce

[57] ABSTRACT

A fluid exchanger apparatus for exchanging a first fluid with a second fluid in varying proportions and comprising fluid exhaust for exhausting such first fluid along a predetermined exhaust flow path, fluid inlet for inducting such second fluid along a predetermined inlet flow path, transfer duct extending around a curved flow path, the path essentially defining a path plane, from the exhaust flow path to the inlet flow path, and providing a smoothly curved fluid flow path therebetween, at least a movable portion of the duct being movable relative to the fluid exhaust, the movable portion being rotatable about any axis except an axis perpendicular to the curve plane whereby rotation of the movable portion establishes and interrupts fluid flow connection between the fluid exhaust and the fluid inlet, and, power operator for moving the movable portion relative to the fixed portion into a plurality of different positions, whereby the first fluid may be mixed with the second fluid in varying proportions.

7 Claims, 6 Drawing Figures

FLUID HANDLING DEVICE

The invention relates to a fluid handling device, and in particular a device for exchanging one fluid with another fluid in varying proportions.

BACKGROUND OF THE INVENTION

Fluids, such as gases and liquids within an enclosed space such as a tank or building, are in many cases required to be circulated or mixed, and to be exchanged with other fluids in order to maintain a predetermined content or concentration. For example, the ventilation of a building requires that the air within the building be circulated, and that such air may be exchanged as it becomes stale, or too hot or too cold, or too dry or too humid, etc., and replaced with fresh air, in order to maintain a desirable condition within the building or space. There are numerous complex mechanisms whereby these objectives may be achieved. However, in many cases it is desirable to achieve these objectives at a much lower cost than is possible using existing equipment. For example, in agricultural buildings, industrial buildings, warehouses and the like, it is desirable to provide efficient air circulation within the building space, and at the same time to ventilate it by removing some of the air and replacing it with fresh air. Due to variations in climatic conditions, the rate at which such building air is removed and replaced with fresh air may vary widely. Variation may take place during a single day or as between day and night.

In many cases, older buildings did not provide any means for automatic ventilation and fluid exchange in this way so as to achieve these results. In order to bring such older buildings up to up-to-date standards, or if such older buildings are modified to provide for a different usage for such building, then it is frequently desirable to instal such exchangers in the walls or roof of the building, at minimum cost, and with a minimum disruption of the existing building fabric.

Some such fluid exchangers are shown in U.S. Pat. Nos. 3,302,548 and 4,079,665. The devices shown in these patents provide for an exchanger type of device which may readily be installed in a suitable opening in the wall or roof of the building, and which may be operated to provide air circulation within the building, and simultaneously, to remove varying proportions of air and replace the air with fresh make-up air from the exterior.

Such devices generally speaking operate by means of one or more fans powered by electrical motors, and are required to operate at fairly high speeds. This is because in order to provide adequate ventilation throughout a relatively large building, such as an agricultural building, warehouse or the like, it is necessary to eject air by means of such a fan at a considerable velocity in order to achieve distribution across the building. Where the device is being operated in a recirculating mode, i.e. a proportion of air is being withdrawn from the building, and is then simply being recirculated back into it, with a proportion of make-up air, then the air flow stream within the device is required to turn through 180°, in a relatively confined space.

The majority of these earlier devices involved one or more flat surfaces set at an angle to the air flow stream, to effect the 180° change in flow path. Consequently the air flow tended to develop a large degree of turbulence. This materially reduced the efficiency of the device.

Accordingly, in order to obtain the necessary high velocity ejection of air into the building, it was necessary to use heavy duty fans and motors in an attempt to overcome these inefficiencies.

Clearly, it would be desirable to reduce resistance and improve the efficiency of the device, by improving the flow characteristics. In this way a greater degree of air distribution could be effected using the same horse power, or conversely, the same distribution could be achieved while reducing the horse power. The efficiency of the fans and motors could thereby be utilized to a much greater degree, achieving greater air distribution throughout the building. In this way, it might for example be possible to reduce the number of such installations required to provide complete ventilation within a large building space or provide a savings in power consumption.

In order however to make these improvements in a cost efficient manner, it must clearly be done at a manufacturing cost which is no greater than, and preferably less than that of the earlier devices.

It must also be born in mind that these devices are required to operate in widely varying climatic conditions and in different situations. In the particular case of buildings housing agricultural stock, the animals are frequently kept within the building 24 hours a day throughout the winter months, at least, and in some case throughout the entire year. The animals are known to generate considerable heat and humidity within the building. The air around them must be thoroughly circulated and ventilated at all times in order to maintain the animals in good health. In addition, however, the handling of air streams being ejected from such buildings containing substantial quantities of humidity, poses certain problems in the colder months. The humid air upon being ejected through the building wall at high speed, tends to produce heavy condensation within the air circulation device, leading to a rapid build-up of ice such that air passage through the device may be blocked, or the operating parts of the device may become seized.

A further typical problem existing with this type of equipment is the requirement for simplicity of service. Generally speaking, the equipment is required to operate 24 hours a day, 7 days a week. In the event of breakdown, it is highly desirable that the owner of the building shall himself be capable of simply installing replacement components so that the unit may continue to function. Buildings of this type are frequently located in remote areas. Servicing by trained service technicians in such areas is a costly factor which must be eliminated as far as possible.

For all of these reasons it is highly desirable that the design and manufacture of the device shall be as simple as possible, so that it may be readily dismantled and reassembled using conventional hand tools, such as would be available to any owner.

Such devices desirably incorporate temperature sensors, and automatic servo controls, such that the temperature of the air exiting from the building may be monitored, and the setting of the exchanger device may be adjusted by the servo control, so as to maintain the temperature or humidity level within the building at a predetermined range. Where any portion of such temperature controls are liable to failure in use, it is however desirable that if possible they may simply be disconnected, and the exchanger portion of the device set by hand so that it may continue to operate to give some degree of ventilation, until a technician has rectified the problem.

BRIEF SUMMARY OF THE INVENTION

The invention seeks to achieve the foregoing objectives by the provision of a fluid exchanger apparatus having means defining an exhaust opening and an inlet opening, curved duct means defining a predetermined radius of curvature, extending around a flow path from said exhaust opening means to said inlet means, and providing a smoothly curved fluid flow path therebetween, said duct means having at least a movable portion, and a fixed portion, whereby said movable portion is movable relative to said fixed portion to move the same into and out of fluid flow connection therebetween, and, power operated means for moving said movable portion relative to said fixed portion whereby the same may be moved into a plurality of different positions.

More particularly, the invention seeks to provide a device having the foregoing advantages wherein the exhaust opening means and inlet opening means are supported by a generally rectangular framework of predetermined dimensions adapted to be fitted within a portion of a building fabric, and including power operated means for forcing fluid from said exhaust opening to said inlet opening through said duct means.

More particularly, the invention seeks to provide such a device wherein there are at least two such power operated means, one being associated with said exhaust opening and the other being associated with said inlet opening.

More particularly, the invention provides such a device wherein the curved duct means is in the form of a generally U-shaped duct extending around an arc of about 180°, and wherein said duct is divided into a fixed duct portion extending from a first said opening, a movable duct portion extending from a second said opening, wherein said second opening is located above said first opening in predetermined spaced apart relation, and including movable junction means adjacent said second opening, whereby said movable duct portion may be moved relative to said second opening, and relative to said fixed duct portion.

It is a further and related objective of the invention to provide such a device wherein at least a portion of the duct means is formed of flexible duct, and wherein said flexible duct is movable relative to a fixed portion into and out of fluid flow connection therebetween.

It is a further and related objective of the invention to provide such a device wherein the duct means comprises a generally U-shaped duct portion, and rotary mounting means, said U-shaped duct portion being mounted on said rotary mounting means, and being rotatable relative to said exhaust opening means and said inlet opening means, whereby to move into and out of fluid flow connection therewith.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figure 1:
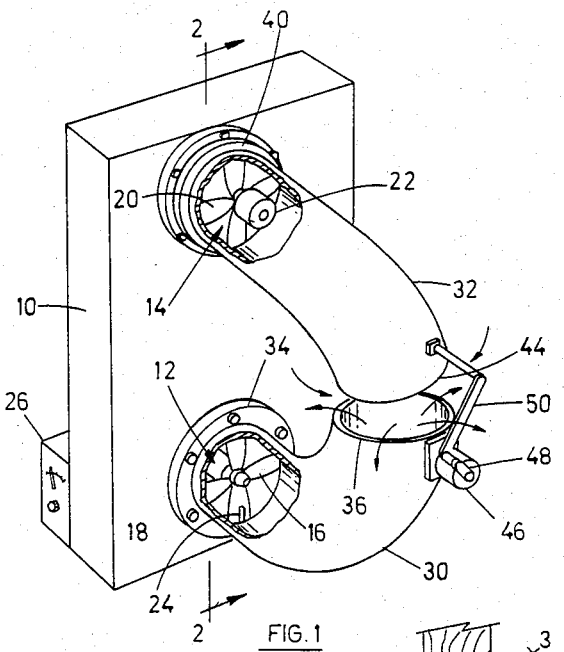
FIG. 1 is a perspective illustration showing the fluid exchanger according to the invention, with portions cut away thereof.
Figure 2:
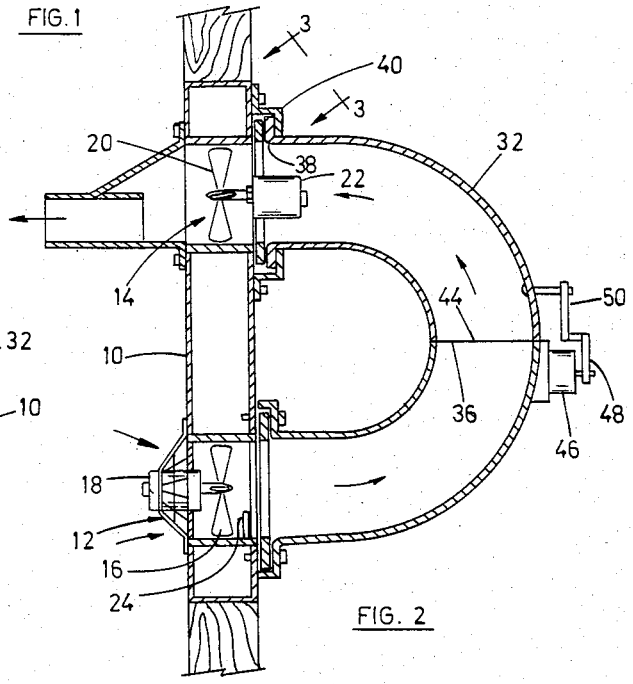
FIG. 2 is a section along the line 2—2 of FIG. 1.
Figure 4:
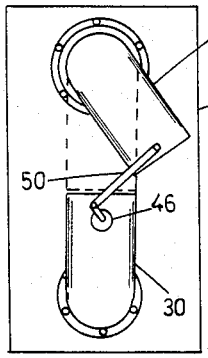
FIG. 4 is a schematic end elevation showing partly in phantom, the operation of the invention.

Referring to FIGS. 1 and 2, the fluid exchanger illustrated there is in the form of an air exchanger and ventilator suitable for use in large buildings such as agricultural buildings, industrial buildings, warehouses and the like. In the form as illustrated it is intended to be mounted in the walls or ceiling of such a building. Such ventilators may be installed at spaced apart intervals along the length of opposite side walls of the building. When operated they will direct relatively high velocity streams of air directly across the building, thereby procuring thorough air circulation of air right across the building space without the necessity of installing air handling ducts within the space.

It will however be appreciated that this is but one of many different applications of such ventilation equipment. Furthermore, it will be appreciated that the invention when applied to such ventilation purposes is but one of many different applications to which the invention may be put, whether in the handling of air, gases within an enclosed space, or liquids. Clearly, depending upon the type of application, the actual construction details will be different, but the inventive principles will remain essentially the same. The illustration of the invention therefore in connection with ventilators for large buildings is merely by way of explanation and not by way of limitation.

As shown in FIG. 1, a generally rectangular framework or housing 10 is provided, the details of which are omitted for the sake of clarity, and which will in any event be of a similar shape in its construction to that shown in earlier patents. The design and construction will be such that it may be readily mounted in a suitable rectangular opening in the wall of the building, and may be fastened therein by any suitable conventional fastening means, and sealed around the edges by suitable sealing systems, trim and the like.

Within housing 10, there are defined a lower exhaust opening 12, and an upper inlet opening 14. These openings are of a suitable size to handle appropriate volumes of air, and may be of any desired shape or construction. In the present case, they are simply shown as round openings, although they may be rectangular, or elongated or any wide variety of different shapes and designs. Typically, they will be provided with some form of grill work or cage, so as to prevent unauthorized persons from inserting objects and incorporated guides to direct air flow.

Within exhaust opening 12 there is provided an exhaust fan 16 driven by a motor 18. Within inlet opening 14 there is provided a distribution fan 20 driven by a motor 22.

Within exhaust opening 12 there will typically be located any suitable form of temperature sensor indicated as 24, connected to a suitable control box 26. Control box 26 is shown mounted on housing 10. Normally, however housing 10 will be at some elevation in the building. Thus, control box 26 would normally be movable so that it may be located at a remote location where it is more readily accessible for operation of the control.

Control box 26 will in turn be connected to motors 18 and 22. In order to provide flexibility of operation, motors 18 and 22 will typically be two-speed motors, so that they may be operated on the command of control box 26, at either speed depending upon requirements.

The features so far described are essentially common to the art, and are merely repeated here by way of example only.

In accordance with the invention, there is provided a fluid flow path connecting the exhaust opening 12 and inlet opening 14 which follows a generally continuously smoothly curved path, thereby defining an efficient flow path for the fluid, and reducing restriction to a minimum. As shown in FIGS. 1 and 2, such fluid flow path in this embodiment is formed by the fixed duct portion 30, and the movable duct portion 32. Fixed duct portion 30 is connected by means of flange 34 to housing 10 in connection with exhaust opening 12. It follows a generally curved radius, extending about an angle of 90°. At its free end, it defines an upwardly oriented opening 36, lying in a generally horizontal plane.

Figure 3:
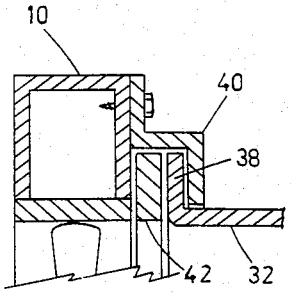
FIG. 3 is an enlarged section of the detail 3 of FIG. 2.

The movable duct portion 32, is best shown in FIGS. 2 and 3, and extends around a generally curved radius of about 90°. It has a suitable rotational mounting, in this case being an annular flange 38, which is retained by means of the annular collar 40, in registration with inlet opening 14. Any suitable anti-friction means indicated generally as 42 may be provided, if necessary on both sides of the flange 38, so as to reduce any tendency for this to bind or stick, especially when operating during colder weather. Conceivably, if necessary in very severe climates some form of electrical heating band could be associated with the collar 40, in order to prevent any possibility of ice build-up, although given suitable anti-friction means, it is not believed that this would be necessary.

The free end of movable duct 32 is formed so as to define a downwardly directed opening 44, lying in a generally horizontal plane. Ducts 30 and 32 are so arranged that when duct 32 is rotated into the appropriate position, openings 36 and 44 register with and in fact engage one another.

Since it is intended that movable duct portion 32 shall rotate about collar 40, and thus swing its free end 44 away from and into registration with the end 36 of the fixed duct 30, it will be necessary to provide some small degree of clearance between them. This may simply be achieved by making them so that they are not quite capable of meeting with and joining one another. Alternatively, it may be achieved by providing them with end profiles which are somewhat curved or relieved in certain portions so as to avoid bringing them into contact with one another when they are just closing or opening. Such profiling is believed to be self evident and is therefore not illustrated for the sake of clarity.

In order to provide for automatic servo operation of movable duct 32, a suitable motor 46 is provided, having an operating arm 48 and a link 50. Motor 46 is illustrated as being mounted on the free end of fixed duct 30, with link 50 extending into connection with the free end of 44 of duct 32. However, numerous other configurations of the motor 46 would be feasible. For example, the motor 46 could be mounted on the housing 10, and could operate the movable duct 32 by any desired form of linkage.

Motor 46 is also connected by any suitable means (not shown) to control box 26, and will respond to variations in temperature as sensed by sensor 24.

In operation, when the duct 32 is swung so that it registers directly with duct 30, then all of the air exiting from the building through exhaust opening 12, will pass around duct, enter duct 32, and reenter the building through inlet opening 14. In this mode of operation, one hundred per cent recycling of building air is achieved without the introduction of any fresh air at all.

In practice it is unlikely that this would occur except in severe winter weather. In the circumstances sufficient fresh air would probably be entering the building in any event through percolation openings and infiltration without the requirement of the addition of fresh air from outside. The invention would thus be functioning purely as a ventilator within the building for circulating air.

When movable duct 32 is swung completely out of registration with duct 30, then all air exiting through exit opening 12 will be released to atmosphere through opening 36.

In order to make up such air, fan 20 will induct one hundred per cent fresh air through opening 44 which will then be ejected into the building through inlet opening 14.

Thus, in this mode of operation, one hundred per cent exchange of building air with fresh air is taking place. This may occur during hot weather and may, in fact, operate continuously in this mode for extended lengths of time.

In the great majority of cases, however, the invention will operate somewhere in between the two extremes.

In this case motor 46 will be operated by control 26 so as to bring opening 44 of movable duct 32 partially into registration with opening 36 of duct 30. When this occurs, some of the air exiting from opening 36 will be drawn back into opening 44, and some of such air will be ejected to atmosphere.

The air inducted into opening 44 will consist of some of the recycled air from opening 36 and some fresh air inducted from outside. By simply adjusting motor 46, so as to produce a difference in the degree of registration between the openings 36 and 44, greater or lesser amounts of building air can be recycled back into the building, or ejected to atmosphere, and greater or lesser amounts of fresh atmospheric air may be drawn in to the building for distribution.

It will be seen that in all modes of operation the degree of resistance produced by the device is substantially reduced as compared with the design of prior art fluid exchangers, so that the device may operate more efficiently and produce greater distribution, or distribution within a larger space, than was possible with a prior art device of the equivalent size.

It will also be seen that by giving suitable attention to the design of the flange 38, collar 40, and anti-friction means 42, any likelihood for the device to become clogged up and immovable due to ice is substantially eliminated.

Figure 5:
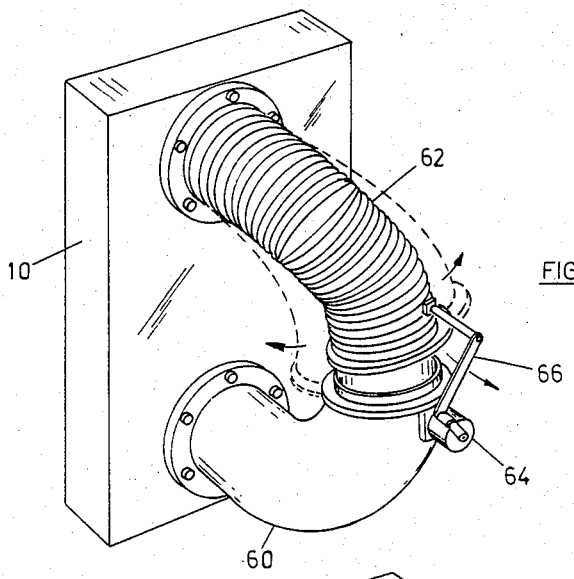
FIG. 5 is a perspective illustration of an alternate form of the invention, and, FIG. 6 is an exploded perspective of a further alternate form of the invention.

It will of course be appreciated that there are variations on the way in which such a U-shaped duct can be constructed and used in accordance with the invention. Thus, as shown in FIG. 5, a lower duct illustrated as 60 may be constructed as a fixed duct essentially the same as duct 30. A movable duct 62 in this case is flexible, being made of flexible ducting, so that it may be bent in a variety of directions. For the sake of explanation only, a motor 64 and linkage 66 are shown, for moving the flexible duct 62. In all other respects the operation of the invention remains essentially the same as that shown in FIGS. 1 and 2. This form of invention may have certain advantages in some circumstances where for example the design of the rotatable flange 38 and collar 40 are such that they will lead to difficulty. It will of course be seen that in the embodiment of FIG. 3 no such rotational movement is necessary whatever.

Figure 6:
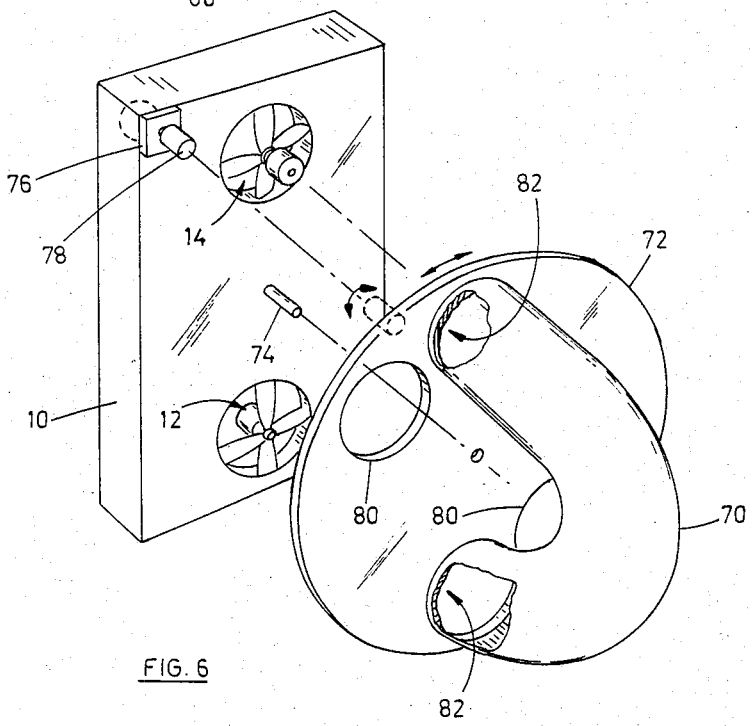

A still further embodiment of the invention is shown in FIG. 6. In this case, a one-piece U-shaped duct 70 is fastened on a rotatable mounting member 72, which in this case is shown simply in the form of a disc, although it could be of any shape and might simply be a framework.

The mounting member 72 is rotatably mounted on the housing 10 by means of a pivot indicated schematically as 74.

The mounting member 72 may be rotated to and fro relative to the housing 10 by means of a motor 76 and linkage 78.

Suitable air flow openings 80 are provided in the mounting member 72, which are adapted to register with openings 12 and 14 in housing 10.

The two ends of the duct 70 also register with suitable openings 82, through which they may have access to the exhaust opening 12 and inlet opening 14.

Clearly, in this embodiment, when the two ends of the duct 70 register with the openings 12 and 14, one hundred per cent fluid exchange takes place.

Conversely, when the openings 80 register with the openings 12 and 14, then one hundred per cent building air is ejected and one hundred per cent of fresh air is inducted.

At positions in between these two positions, then varying amounts of building air will be recycled, and varying amounts of fresh air will be inducted.

By suitably engineering and shaping openings 80 and 82, or indeed by eliminating them altogether by simply making the mounting members 72 of a different design, there is little or no loss in efficiency using this design.

While the invention is illustrated as a ventilator or air exchanger for buildings, it is not limited solely to such application. Numerous other applications exist in the handling of fluid materials, both gases, and liquids, where the invention will be of significant utility.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A fluid exchanger apparatus for exchanging a first fluid with a second fluid in varying proportions comprising;

fluid exhaust means for exhausting such first fluid along a predetermined exhaust flow path;

fluid inlet means for inducting such second fluid along a predetermined inlet flow path;

transfer duct means extending around a curved flow path, said path essentially defining a path plane, from said exhaust flow path to said inlet flow path, and providing a smoothly curved fluid flow path therebetween, a movable duct portion of said transfer duct means, said duct portion being movable relative to the fluid exhaust means and to said fluid inlet means, between a transfer position in which fluid transfer takes place from said fluid exhaust means to said fluid inlet means, and a disconnect position in which fluid is exhausted by said exhaust and fluid is taken in by said inlet independently of each other, and, duct movement means for moving said movable portion between said positions and into a plurality of different locations intermediate said positions, whereby said first fluid may be mixed with said second fluid in varying proportions.

2. A fluid exchanger apparatus as claimed in claim 1 wherein said fluid exhaust means comprises power operated means for exhausting said first fluid and a housing means defining an exhaust opening means, and wherein said fluid inlet means comprises power operated means for inducting said second fluid and a housing means defining an inlet opening means, and wherein said exhaust opening means and said inlet opening means communicate with opposite ends of said transfer duct means.

3. A fluid exchanger apparatus as claimed in claim 2 wherein said movable portion of said transfer duct means comprises a curved duct, curved through substantially 90°, and having one end rotatably mounted in registration with one of said opening means, and having said other end movable about a predetermined swing axis, and wherein said transfer duct means also defines a fixed portion comprising a curved duct curved about an arc of generally 90°, and having one end fastened in registration with the other of said opening means, and the other end being located so that said movable end of said movable portion may be removed into and out of registration therewith.

4. A fluid exchanger apparatus as claimed in claim 1 wherein said transfer duct means also defines a fixed duct portion and wherein said movable portion of said transfer duct means comprises at least in part a flexible duct, adapted to flex to and fro into and out of fluid connection with said fixed duct portion.

5. A fluid exchanger apparatus as claimed in claim 1 wherein said fluid exhaust means comprises power operated means for exhausting said first fluid and a housing means defining an exhaust opening means, and wherein said fluid inlet means comprises power operated means for inducting said second fluid and a housing means defining an inlet opening means, and wherein said transfer duct means is movable relative to at least one of said exhaust and inlet opening means.

6. A fluid exchanger apparatus as claimed in claim 5 wherein said transfer duct means defines one end communicating with said exhaust opening means and another end communicating with said inlet opening means, said transfer duct means being movable whereby both said ends may move into and out of registration with respective said opening means simultaneously.

7. A fluid exchanger apparatus as claimed in claim 6 wherein said transfer duct means comprises a length of duct formed into a generally U-shaped curve, and mounting means upon which said U-shaped duct is mounted, said mounting means being rotatable, relative to said exhaust opening means and said inlet opening means, whereby to bring the opposite ends of said U-shaped duct into and out of registration with respective said opening means.

* * * * *